US009284765B2

(12) United States Patent
Duff

(10) Patent No.: US 9,284,765 B2
(45) Date of Patent: Mar. 15, 2016

(54) COMBINATION DOORBUMPER/DOORSTOPPER

(71) Applicant: Robert O. Duff, Apple Valley, MN (US)

(72) Inventor: Robert O. Duff, Apple Valley, MN (US)

( * ) Notice: Subject to any disclaimer, the term of this patent is extended or adjusted under 35 U.S.C. 154(b) by 0 days.

(21) Appl. No.: 14/461,776

(22) Filed: Aug. 18, 2014

(65) Prior Publication Data

US 2016/0047157 A1 Feb. 18, 2016

(51) Int. Cl.
*E05F 5/06* (2006.01)
*E05F 5/02* (2006.01)

(52) U.S. Cl.
CPC ... *E05F 5/06* (2013.01); *E05F 5/02* (2013.01); *Y10T 16/625* (2015.01)

(58) Field of Classification Search
CPC . Y10T 16/625; Y10T 16/628; Y10T 16/6285; Y10T 29/4987; Y10T 16/61; E05F 5/02; E05F 5/06; E05Y 2900/132; E05C 17/52; E05C 17/54; E05C 19/10; E05C 17/36; Y10S 292/19
USPC ..... 16/85, 86 R, 86 A, 82; 29/450; 292/DIG. 19
See application file for complete search history.

(56) References Cited

U.S. PATENT DOCUMENTS 1,746,961 A * 2/1930 Palmer ..... E05C 17/36 16/82
1,889,681 A * 11/1932 Marshall et al. ..... 292/17
2,116,444 A * 5/1938 Maier ..... 292/17
2,182,611 A * 12/1939 Covert ..... 16/86 R
2,452,461 A * 10/1948 Harris ..... 292/130
2,819,921 A * 1/1958 Solari ..... E05C 17/52 16/86 A
2,899,703 A * 8/1959 Johnson ..... 16/86 A
3,050,770 A * 8/1962 Morse et al. ..... 16/86 A
3,362,040 A * 1/1968 Gurzenda ..... 16/86 R
3,386,125 A * 6/1968 Hand ..... 16/86 R
3,864,785 A * 2/1975 Hoppock ..... 16/86 A
3,969,786 A * 7/1976 Peak ..... 16/86 A
3,994,043 A * 11/1976 Gurzenda ..... 16/86 A
4,159,837 A * 7/1979 Morita ..... 292/127
4,288,119 A * 9/1981 Geiger ..... E05C 17/36 292/262
4,532,672 A * 8/1985 Anderson ..... 16/86 A
4,951,984 A * 8/1990 Huang ..... 292/76
5,701,635 A * 12/1997 Hawkes ..... 16/421
5,722,115 A * 3/1998 Arens ..... 16/85
6,209,170 B1 * 4/2001 Huynh ..... 16/86 A
6,295,697 B1 * 10/2001 Simon ..... 16/86 R
6,430,775 B1 * 8/2002 Bushey ..... 16/86 A
2013/0056998 A1 * 3/2013 Chincarini, Jr. ..... E05C 17/36 292/262

* cited by examiner

*Primary Examiner* — William Miller
(74) *Attorney, Agent, or Firm* — Kinney & Lange, P.A.

(57) ABSTRACT

A combination doorbumper and doorstopper includes a mounting plate, spindle, bumper, toggle bolt, and toggle bolt anchor. The doorbumper is installed on a wall so that a doorknob or door handle will engage the bumper when the door is fully opened. The spindle is positioned between the mounting plate and the bumper, and includes a narrow neck region. The door can be held in an opened position by placing a loop end of a flexible cord over the doorknob or handle on the opposite side of the door from the doorbumper, and stretching the cord so that a hook at the opposite end of the cord can be placed over the neck of the spindle. The doorbumper together with the flexible cord acts as a doorstopper to hold the door open.

18 Claims, 8 Drawing Sheets

COMBINATION DOORBUMPER/DOORSTOPPER

BACKGROUND

Doorbumpers are commonly installed on walls to protect the wall from damage by a doorknob or door handle when the door is fully opened. The doorbumper normally includes a cushion, made of a rubber or elastomeric material, that is contacted by the doorknob or door handle. The cushion material absorbs force to prevent the wall from being damaged when the door swings fully open.

There are numerous situations in which a door needs to be held in an open position. For example, a door may be held open to aid in air circulation. During cleaning, doors may need to be held open so that the cleaning equipment can be moved through the doorway and so the area around the door can be cleaned as well. Doors also need to be held open when occupants are moving furniture and other objects into or out of the premises. In hospitals, doors need to be held open when moving patients from room-to-room.

In order to hold doors open, various forms of doorstoppers are used. One common type of doorstopper is a wedge shaped device that is inserted under the bottom edge of the door. Another form of doorstopper fits between the door and the door frame when the door is open.

In some cases, doorstoppers can be misused in ways that damage the door or the door frame. In addition, some doorstoppers are more difficult to use than others. Because they are portable, doorstoppers can be moved or misplaced, so that they are not available when needed.

SUMMARY

A combination doorbumper and doorstopper includes a mounting plate, a spindle, and a bumper that are connected together and mounted to a wall with a bolt and an expandable anchor. The bumper is a flexible cushion that absorbs force when engaged by a doorknob or handle in order to protect the wall from damage. The spindle is positioned between the mounting plate and the bumper, and has a narrow neck for receiving a hook of a flexible connector that can extend from a doorknob or handle of the door so that the door is held in engagement with the bumper.

DETAILED DESCRIPTION

Figure 1A:
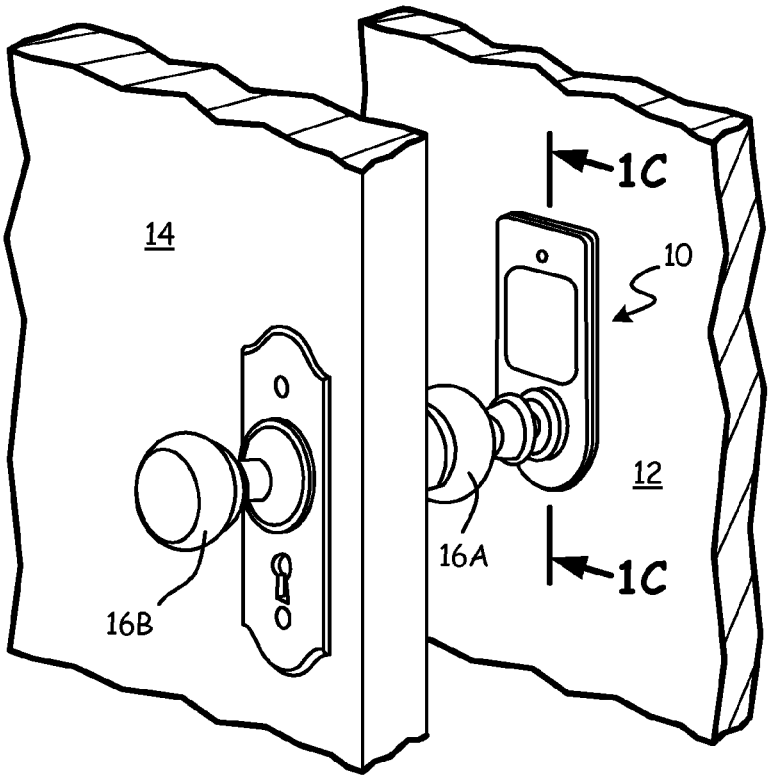
FIGS. 1A-1C show a perspective view, an exploded view, and a cross-sectional view, respectively, of a combination doorbumper and doorstopper.

FIG. 1A shows doorbumper 10 mounted on wall 12 and positioned to protect wall 12 from damage when door 14 is fully open. Door 14 is shown having doorknobs 16A and 16B on opposite sides, but in other cases door 14 may have rotatable door handles. Doorbumper 10 is positioned to engage doorknob 16A when door 14 is opened fully. Doorbumper 10 prevents doorknob 16A from striking wall 12, and cushions the force being applied by door 14 to wall 12. As discussed later in conjunction with FIGS. 3A and 3B, doorbumper 10 is configured to also function as a doorstopper.

Figure 1B:
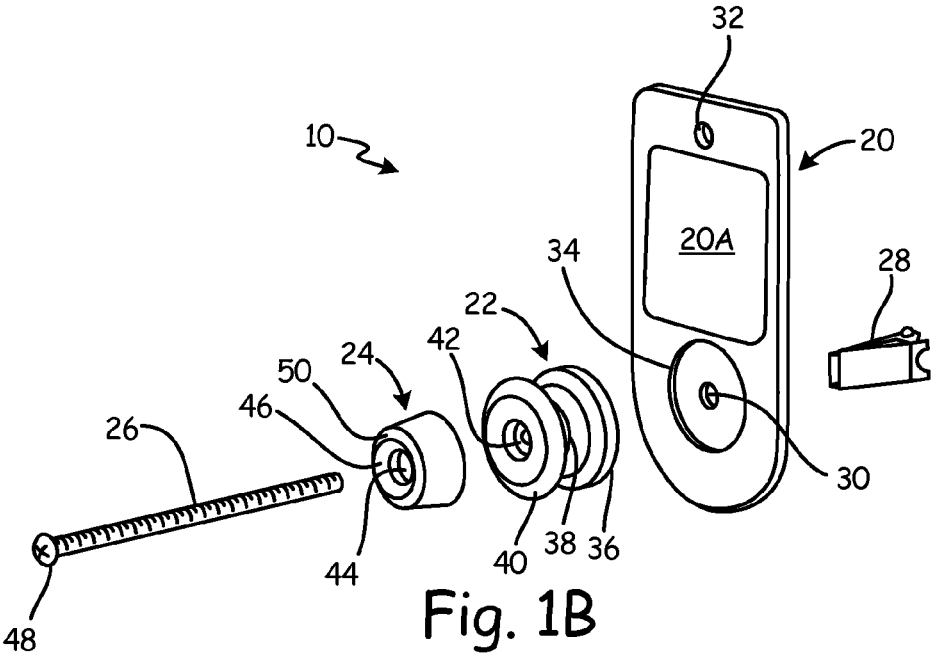
Figure 1C:
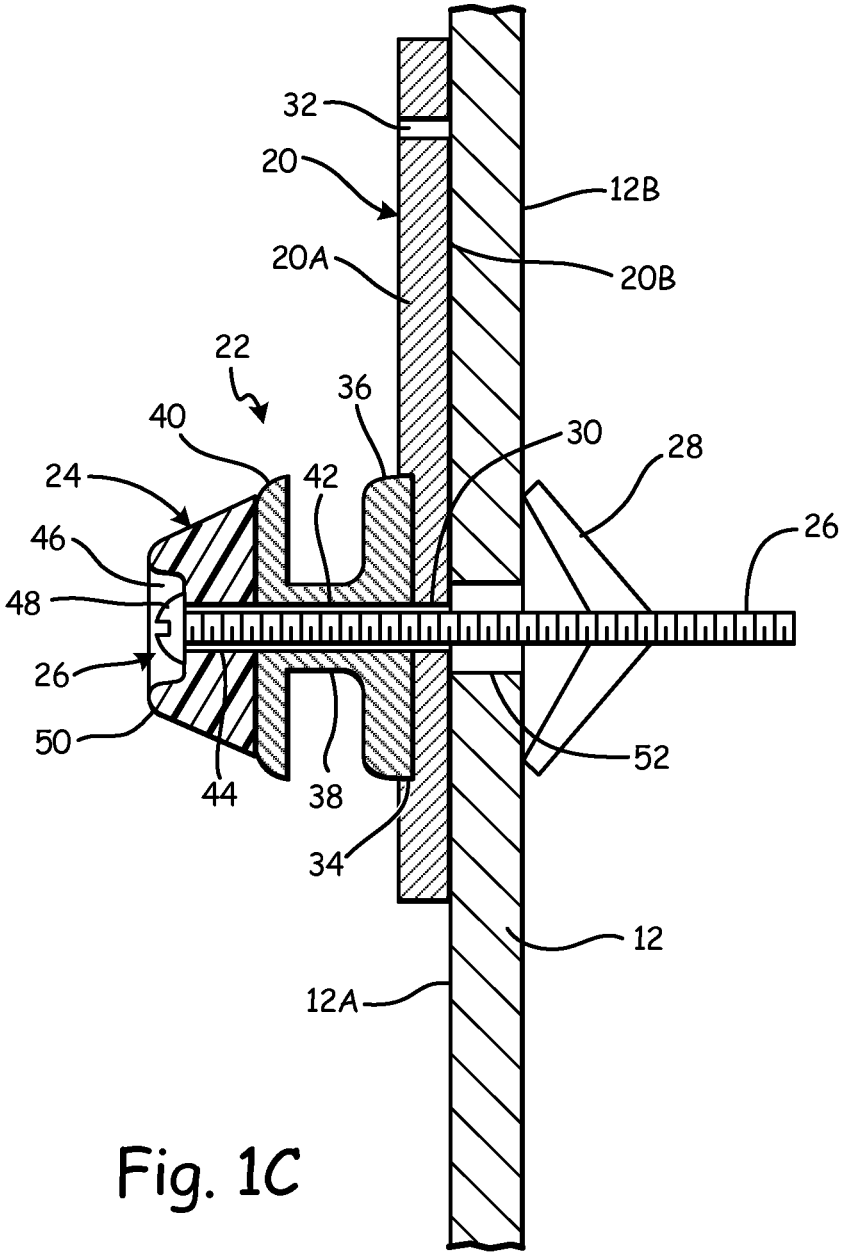

FIG. 1B shows an exploded view of doorbumper 10, and FIG. 1C shows a cross-sectional view of doorbumper 10 mounted to wall 12. The cross-sectional view shown in FIG. 1C is taken along section 1C-1C of FIG. 1A.

Doorbumper 10 includes mounting plate 20, spindle 22, bumper 24, toggle bolt 26, and toggle bolt anchor 28. Plate 20 includes front surface 20A and rear surface 20B, mounting holes 30 and 32, and circular recess 34. Surface 20B of plate 20 is flat and, when installed, is held flush against outer surface 12A of wall 12 by toggle bolt 26 and toggle bolt anchor 28. Plate 20 may be made of any of a number of different materials, such as plastic, metal, or wood. In one embodiment, plate 20 is an injection molded plastic component.

Spindle 22 includes shoulder 36, neck 38, and head 40. Bolt hole 42 extends through the center of spindle 22. Shoulder 36 is received in recess 34 of mounting plate 20, so that bolt hole 42 of spindle 22 is aligned with hole 30 of plate 20. In one embodiment, spindle 22 is an anodized aluminum component.

Bumper 24 is a generally frustoconical body made of a flexible cushioning material such as a molded rubber or other elastomer. As shown in FIG. 1C, bumper 24 is mounted in front of head 40 of spindle 22. Bolt hole 44 of bumper 24 aligns with bolt hole 42 of spindle 22 and mounting hole 30 of mounting plate 20.

At its front end, bumper 24 includes recess 46, which receives head 48 of toggle bolt 26. Outer rim 50 of bumper 24 surrounds recess 46, and engages doorknob 16 so that head 48 of bolt 26 does not come into contact with doorknob 16.

Mounting plate 20, spindle 22, and bumper 24 are held together and held in place against front surface 12A of wall 20 by toggle bolt 26 and toggle bolt anchor 28. During mounting, toggle bolt anchor 28 is collapsed so that it passes through hole 52 in wall 12. Once toggle bolt anchor is passed through hole 52, it expands outwardly to engage inner wall surface 12B of wall 12. By tightening toggle bolt 26, a clamping force is applied by bolt toggle 26 and toggle bolt anchor 28 that holds bumper 24, spindle 22, and mounting plate 20 together, and holds mounting plate 20 against outer wall surface 12A.

Mounting hole 32 is optional. It can be used to insert a screw through mounting plate 20 and into wall 12. With the clamping action provided by bolt 26 and toggle bolt anchor 28, mounting plate 20 is held firmly in place. The use of an additional screw ensures that rotation of mounting plate 20 will not occur even if bolt 26 and toggle bolt anchor 28 are loosened.

FIGS. 2A-2D illustrate installation of doorbumper 20 on wall 12. Initially, door 14 is opened fully so that bumper 24 is positioned in the center of doorknob 16A in a position similar to that shown in FIG. 1A. At this point, bumper 24, spindle 22, and mounting plate 20 can be held together by hand.

Figure 2A:
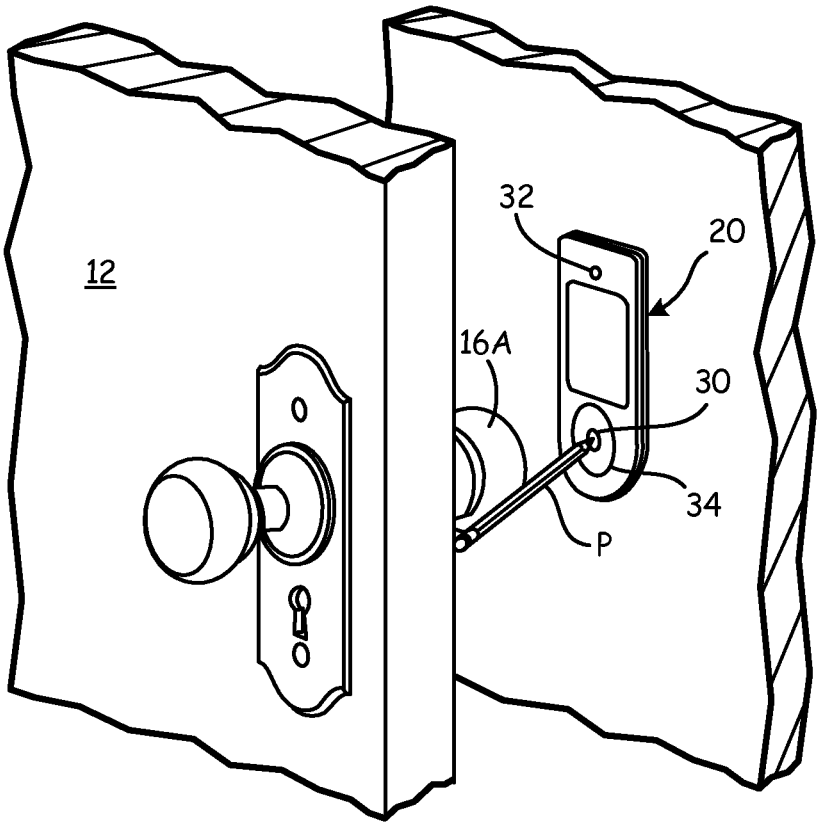
FIGS. 2A-2D illustrate installation of the combination doorbumper and doorstopper on a wall.

While holding mounting plate 20 in place, bumper 24 and spindle 22 are removed, exposing recess 34 and mounting hole 30, as shown in FIG. 2A. Pencil P can be used to mark the position of mounting hole 30 on wall 12. Pencil P can also be used to mark the location of mounting hole 32.

Figure 2B:
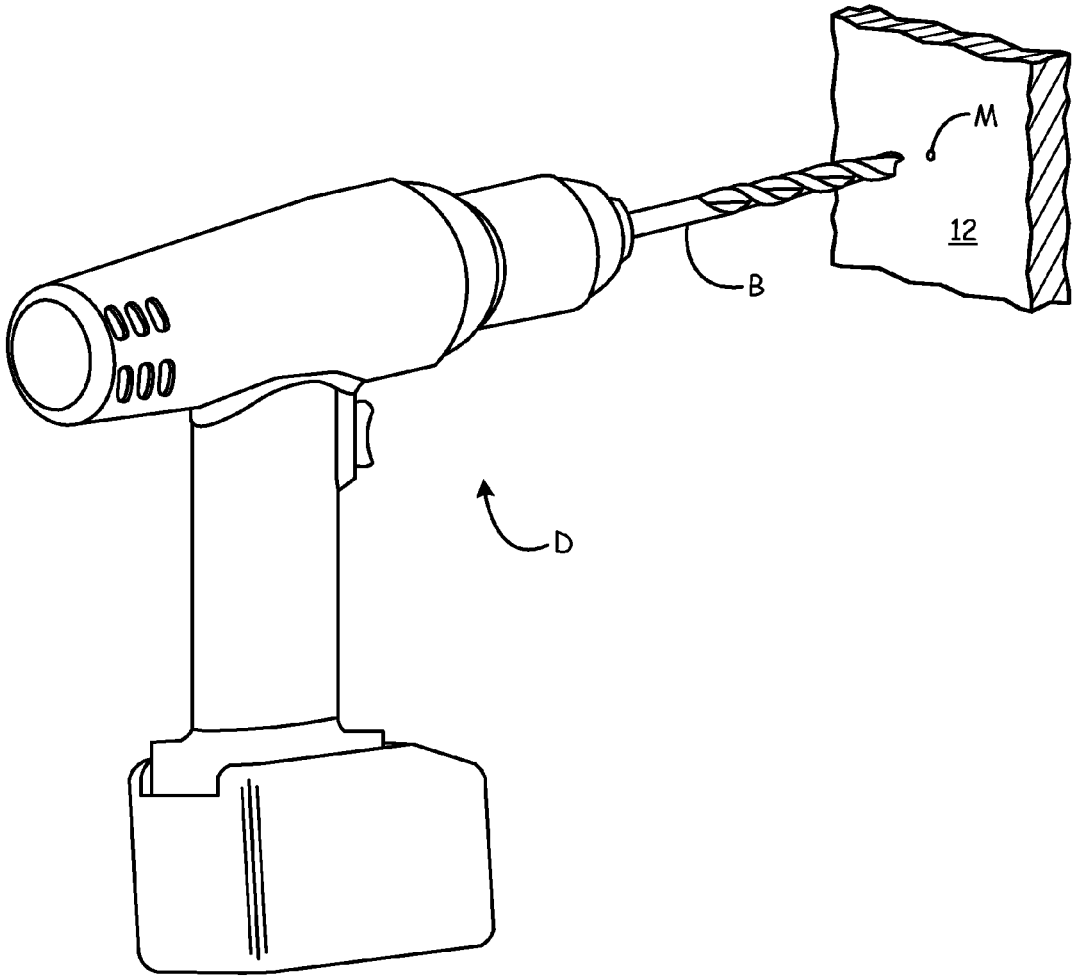

As shown in FIG. 2B, mounting plate 20 is then removed from against wall 12. Electric drill D is shown in FIG. 2B with drill bit B aligned with mark M on wall 12. Drill bit B must be of a size large enough to produce drilled hole 52 in wall 12 with a diameter large enough to allow toggle bolt anchor 28 to pass through hole 52. In one embodiment, drill bit B is a ½ inch drill bit.

Figure 2C:
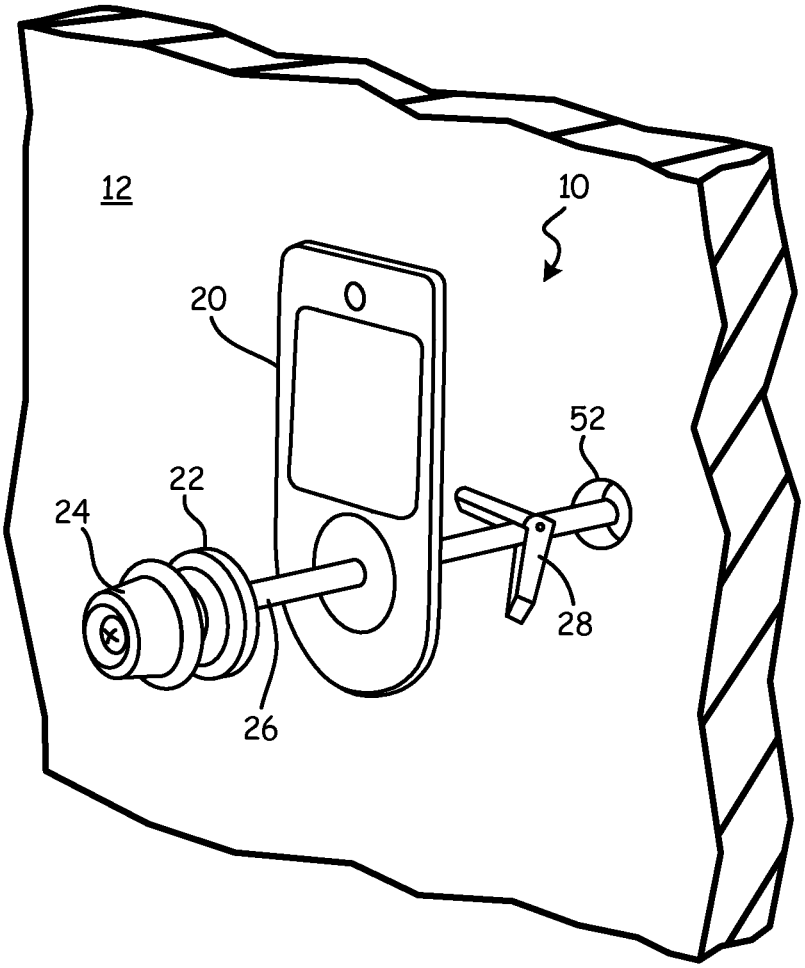
Figure 2D:
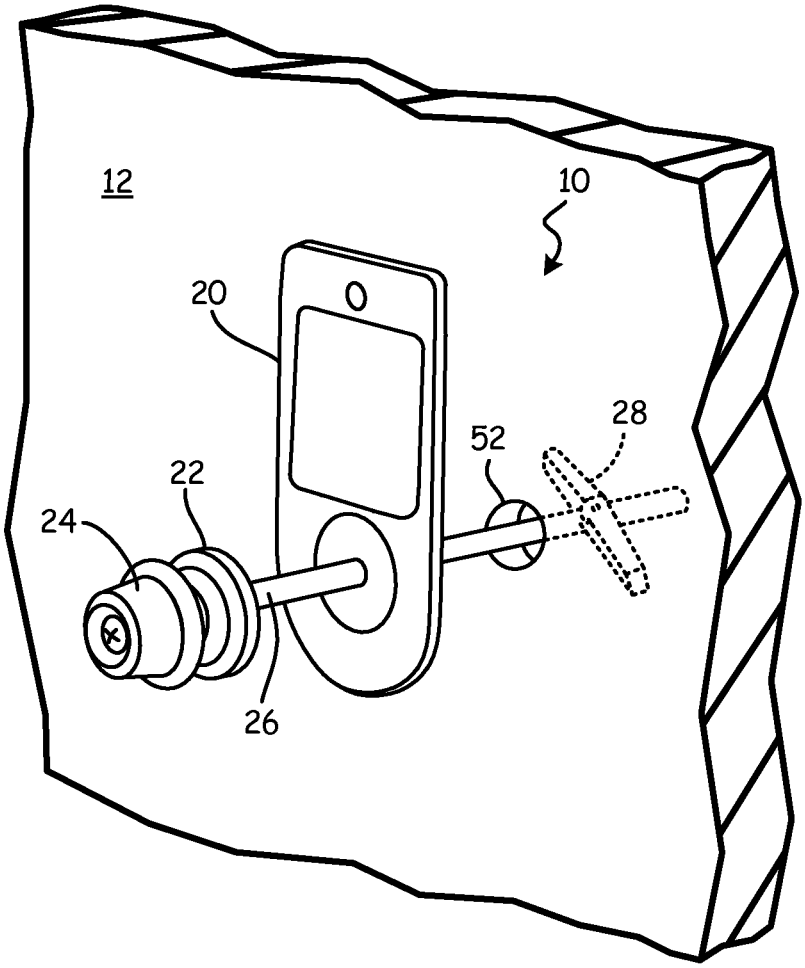

As shown in FIG. 2C, toggle bolt 26, bumper 24, spindle 22, and mounting plate 20 are assembled together with toggle bolt 26 extending through hole 30 mounting in plate 20. Toggle bolt anchor 28 is threaded onto the end of toggle bolt 26, and is pushed through hole 52. The arms of toggle bolt anchor 28 spread after passing through hole 52, and toggle bolt 26 is tightened to mount doorbumper 10 against wall 12. FIG. 2D shows doorbumper 10 mounted on wall 12.

Figure 3A:
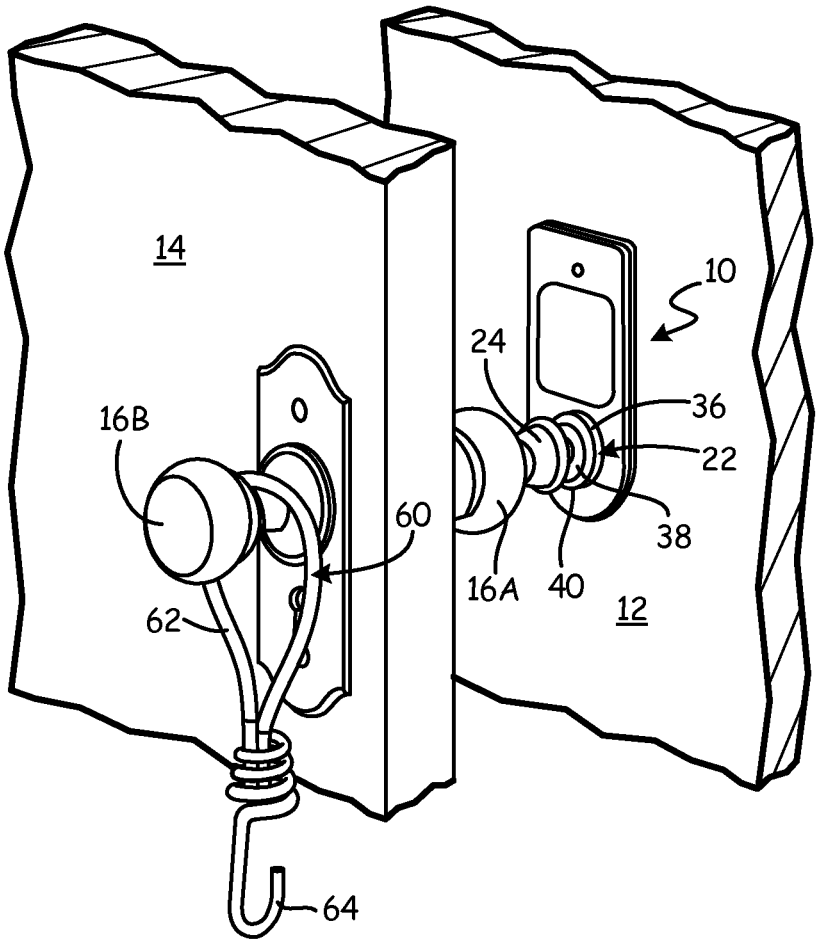
FIGS. 3A and 3B illustrate the use of the combination doorbumper and doorstopper in conjunction with a flexible cord to hold a door in an open position.
Figure 3B:
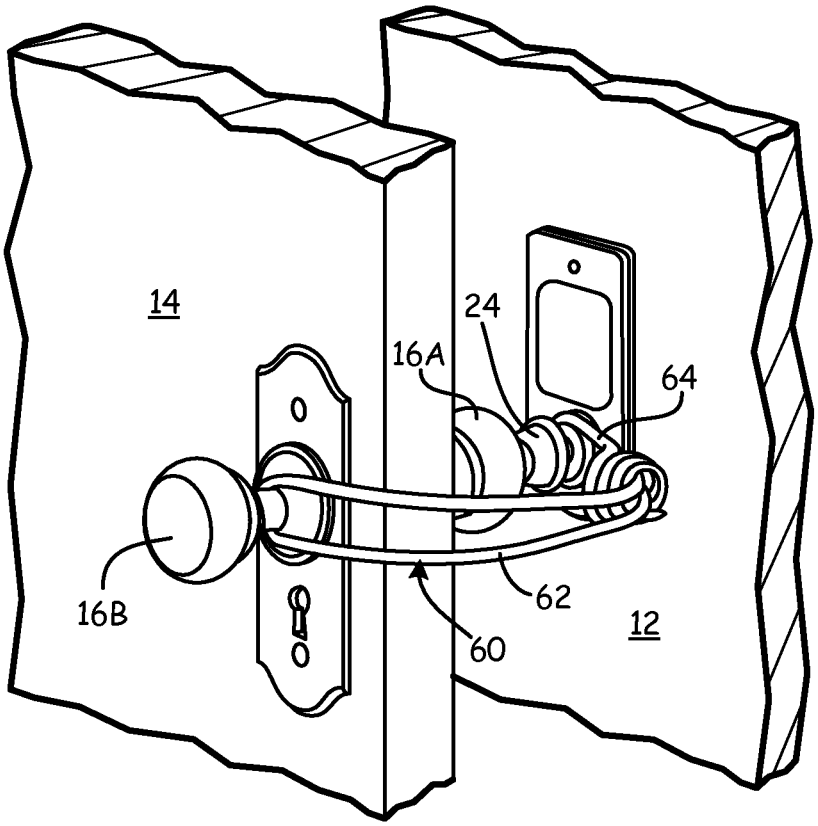

In addition to protecting wall 12 from damage by door 14 and doorknob 16A, doorbumper 10 can also be used as a doorstopper, as illustrated in FIGS. 3A and 3B. As shown in FIG. 3A, door 14 has been opened so that doorknob 16A engages bumper 24 of doorbumper 10. Elastic cord 60, sometimes referred to as a bungee cord, is placed over doorknob 16B on the opposite side of door 14 from doorknob 16A. Elastic cord 60 includes elastic loop 62 and hook 64. Once elastic loop 62 is placed over doorknob 16B, loop 62 can be stretched around door 14, and hook 64 can be placed around neck 42 of spindle 22, as shown in FIG. 3B. The tension provided by elastic loop 62 will hold door 14 open, with doorknob 16A in engagement with bumper 24. In order to close door 14, hook 64 is removed from neck 42 of spindle 22, so that elastic cord 60 no longer holds door 14 in place against doorbumper 10.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A combination doorbumper and doorstopper device comprising:

a mounting plate;

a spindle having a shoulder for engaging the mounting plate, a neck having a reduced diameter and extending from the shoulder, and a head connected to the neck;

a bumper for mounting on the head of the spindle; and a bolt and cooperating anchor for mounting the mounting plate, spindle, and bumper together on a wall.

2. The device of claim 1 and further comprising:

an elastic cord having an elastic loop for mounting on a doorknob or door handle and a hook attached to the elastic loop for connecting to the neck of the spindle.

3. The device of claim 1, wherein the spindle is an anodized aluminum body.

4. The device of claim 1, wherein the spindle and the bumper each include a bolt hole, and the mounting plate includes a mounting hole.

5. The device of claim 4, wherein the bolt is sized to extend through the bolt holes in the bumper and the spindle and through the mounting hole in the mounting plate.

6. The device of claim 5, wherein the bumper includes a rim for engaging a doorknob or door handle, a recess surrounded by the rim and shaped to receive a head of the bolt.

7. The device of claim 1, wherein the bumper is formed of a cushion material.

8. The device of claim 1, wherein the mounting plate includes a recess in a front surface for receiving the shoulder of the spindle.

9. A method comprising:

attaching a first end of an elastic cord to a doorknob or door handle of a door;

stretching the elastic cord; and attaching a second end of the elastic cord to a doorbumper to hold the door in an open position;

wherein the elastic cord includes an elastic loop at the first end for attaching to the doorknob or door handle; and wherein the elastic cord includes a hook at the second end for attaching to the doorbumper.

10. The method of claim 9, wherein the doorbumper includes a spindle with a neck, and wherein the hook is attached to the neck.

11. A method comprising:

attaching a first end of an elastic cord to a doorknob or door handle of a door;

stretching the elastic cord; and attaching a second end of the elastic cord to a doorbumper to hold the door in an open position, wherein the doorbumper comprises:

a mounting plate;

a spindle having a shoulder for engaging the mounting plate, a neck having a reduced diameter and extending from the shoulder, and a head connected to the neck;

a bumper for mounting on the head of the spindle; and a bolt and cooperating anchor for mounting the mounting plate, spindle, and bumper together on a wall.

12. The method of claim 11, wherein the first end comprises an elastic loop for mounting on the doorknob or door handle and the second end comprises a hook for connecting to the neck of the spindle.

13. The method of claim 11, wherein the spindle is an anodized aluminum body.

14. The method of claim 11, wherein the spindle and the bumper each include a bolt hole, and the mounting plate includes a mounting hole.

15. The method of claim 14, wherein the bolt extends through the bolt holes in the bumper and the spindle and through the mounting hole in the mounting plate.

16. The method of claim 15, wherein the bumper includes a rim for engaging a doorknob or door handle, a recess surrounded by the rim and shaped to receive a head of the bolt.

17. The method of claim 11, wherein the bumper is formed of a cushion material.

18. The method of claim 11, wherein the mounting plate includes a recess in a front surface for receiving the shoulder of the spindle.

* * * * *